US008382535B2

(12) United States Patent
Werthman et al.

(10) Patent No.: US 8,382,535 B2
(45) Date of Patent: Feb. 26, 2013

(54) MODIFIABLE ELECTRICAL CONNECTOR LUG

(75) Inventors: Paul A Werthman, Manchester, NH (US); Deborah L. Werthman, Manchester, NH (US); Russell Lee Schoepf, Wolfforth, TX (US); Reginald B Phelps, Lincoln, NH (US); Earle Temple, Carroll, NH (US)

(73) Assignee: Hubbell Incorporated, Shelton, CT (US)

( * ) Notice: Subject to any disclaimer, the term of this patent is extended or adjusted under 35 U.S.C. 154(b) by 1101 days.

(21) Appl. No.: 11/986,934

(22) Filed: Nov. 26, 2007

(65) Prior Publication Data

US 2008/0182462 A1 Jul. 31, 2008

Related U.S. Application Data

(60) Provisional application No. 60/897,604, filed on Jan. 26, 2007.

(51) Int. Cl.
*H01R 11/26* (2006.01)

(52) U.S. Cl. ..... 439/883; 439/177

(58) Field of Classification Search ..... 439/874–889, 439/115

See application file for complete search history.

(56) References Cited

U.S. PATENT DOCUMENTS

| | | | | |
|---|---|---|---|---|
| 2,406,079 | A * | 8/1946 | Krueger | 439/878 |
| 2,748,452 | A * | 6/1956 | Pierce | 439/885 |
| 3,082,397 | A | 3/1963 | Clarkson et al. | 339/157 |
| 3,761,867 | A * | 9/1973 | Churla | 439/883 |
| 4,196,960 | A | 4/1980 | Gelfand | 339/275 T |
| 4,290,665 | A * | 9/1981 | Krasnov et al. | 439/886 |
| 4,555,749 | A | 11/1985 | Rifkin et al. | 362/249 |
| 4,753,609 | A | 6/1988 | Pfeffer et al. | 439/541 |
| 4,832,622 | A | 5/1989 | Zahn | 439/590 |
| 5,145,415 | A | 9/1992 | Doudon | 439/621 |
| 5,281,761 | A | 1/1994 | Woo et al. | 174/78 |
| 6,361,375 | B1 | 3/2002 | Sinclair | 439/723 |
| 7,137,833 | B2 | 11/2006 | Woodward | 439/115 |

OTHER PUBLICATIONS

"Types Yav Box and Yav", 2005 Burndy Master Catalog, pp. 74-75.
"Universal Crimp on Ground Lug" drawing, Oct. 23, 2000, 1 page.
New Product Announcement, "New Compact SureGround Grounding Kit", Andrew Corporation, 2006, 2 pages.
"SureGround and SureGround Plus Ground Kit Qualification Report", Andrew Corporation, Dec. 15, 2006, 5 pages.
Product Reference Sheet, "Standard Ground Kit for Coaxial Cable and Elliptical Waveguide Applications", Times Microwave Systems, 2005, 1 page.
"Coax Ground Kits" Section 4.3.1, Harger, 2004, 1 page.
"Andrew Corporation Introduces Compact SureGround Grounding Kits" Business Wire, Mar. 21, 2003, 2 pages.
Installation Manual, "Standards Site Grounding and Lighting Protection", Tyco Electronics, p. 34, 2001, 3 pages.

* cited by examiner

*Primary Examiner* — Briggitte R Hammond
(74) *Attorney, Agent, or Firm* — Harrington & Smith

(57) ABSTRACT

An electrical connector including a first connection section adapted to connect the electrical connector to a first conductor; and a second connection section connected to the first connection section. The second connection section includes a lug with a plurality of lug portions with at least one weakened section between the lug portions. Each lug portion has a hole adapted to be located onto a respective mounting post. A first one of the lug portions can be removed from a second one of the lug portions at the weakened section to reconfigure the second connection section to have one less lug portion.

2 Claims, 4 Drawing Sheets

MODIFIABLE ELECTRICAL CONNECTOR LUG

CROSS REFERENCE TO RELATED APPLICATION

This application claims the benefit under 35 U.S.C. §119 (e) of U.S. provisional patent application No. 60/897,604 filed on Jan. 26, 2007 which is hereby incorporated by reference in its entirety.

BACKGROUND OF THE INVENTION

1. Field of the Invention

The invention relates to an electrical connector and, more particularly, to an electrical connector having a connector lug which can be modified.

2. Brief Description of Prior Developments

Electrical contacts which have a lug with one or more holes for connecting two electrical conductors to each other are well known in the art. For example, FCI USA, Inc. sells BURNDY® one hole and two hole HYLUG™ electrical conductors for connecting a wire or cable to another electrical conductor having one or two connection posts, respectively. The connection post(s) are received in the hole(s) of the lugs.

In cases where a two-hole lug is too long for a particular application, installers are cutting the two-hole lugs with saws to make a one-hole lug. The problem is that only the two-hole lug is UL (Underwriters Laboratory, Inc.) approved. Modifications to the two-hole lug could void the UL approval, especially if an installer gets a bit aggressive while removing the extra lug hole portion of the two-hole lug and removes too much material.

U.S. Pat. No. 4,753,609 teaches a first metal contact and a second metal contact. The contacts are stamped from the same sheet of metal, and the second contacts are subsequently broken away from the first contacts along a crease. Other art teaches break-away portions to shorten (or extend) overall length.

SUMMARY OF THE INVENTION

In accordance with one aspect of the invention, an electrical connector is provided including a first connection section adapted to connect the electrical connector to a first conductor; and a second connection section connected to the first connection section. The second connection section includes a lug with a plurality of lug portions with at least one weakened section between the lug portions. Each lug portion has a hole adapted to be located onto a respective mounting post. A first one of the lug portions can be removed from a second one of the lug portions at the weakened section to reconfigure the second connection section to have one less lug portion.

In accordance with another aspect of the invention, an electrical connector is provided comprising a first connection section adapted to connect the electrical connector to a first conductor; and a second connection section connected to the first connection section. The second connection section comprises a lug with a plurality of lug portions with at least one weakened section between the portions. Each lug portion has a hole adapted to be located onto a respective mounting post. The electrical connector has a first predetermined electrical quality or performance certification. A first one of the lug portions can be removed from a second one of the lug portions at the weakened section to reconfigure the second connection section to have one less lug portion and provide a modified electrical connector having a second different predetermined electrical quality or performance certification.

In accordance with another aspect of the invention, a method of manufacturing an electrical connector is provided comprising providing a first connection section adapted to be connected to a first conductor and a second connection section connected to the first connection section, wherein the second connection section comprises a lug having at least two mounting holes adapted to be mounted onto respective mounting posts; providing the lug with a first lug portion having a first one of the mounting holes and a second lug portion having a second one of the mounting holes, wherein the first lug portion is connected to the first connection section by the second lug portion; and providing a weakened section between the first and second lug portions, wherein the first lug portion is adapted to be broken off of the second lug portion at the weakened section.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
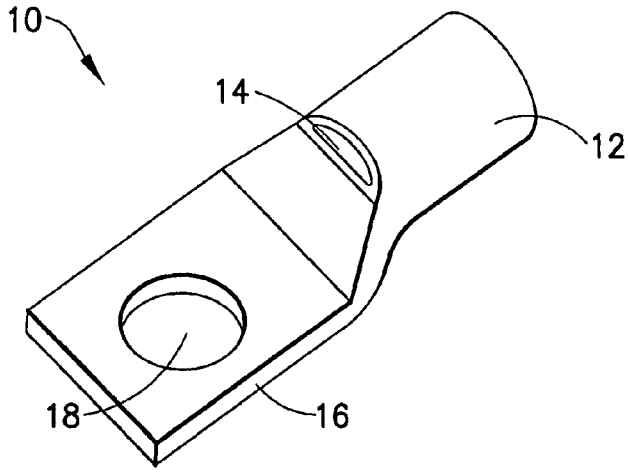
FIG. 1 PRIOR ART
FIG. 1 is a perspective view of a conventional electrical connector.

Referring to FIG. 1, there is shown a perspective view of a conventional electrical connector 10. The connector 10 is a BURNDY® one hole HYLUG™ electrical conductor. The connector 10 generally comprises a tube section 12 forming a cable receiving area with an inspection window 14, and a lug section 16 with a single hole 18. As seen with reference to FIG. 2, the connector 10 can be mounted on a mounting post 20 of another member 22 to electrically connect a wire or cable 24 to the member 22. The tube section 12 can be crimped onto the cable 24. The lug section 16 can be retained on the post 20 by a fastener 26, such as a threaded nut.

Figure 3:
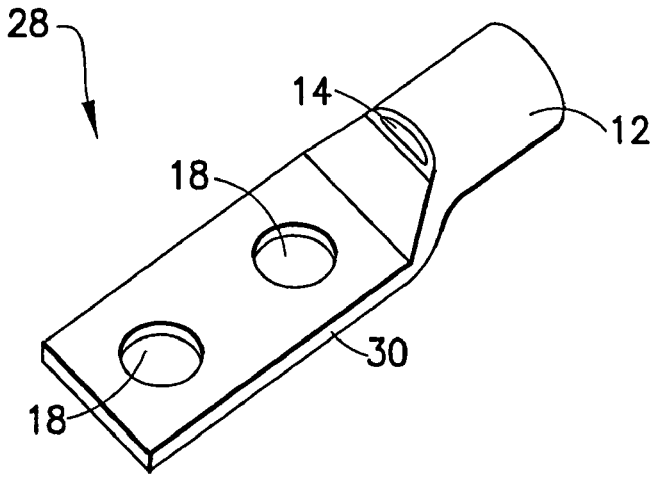
FIG.3 PRIOR ART
FIG. 3 is a perspective view of another embodiment of a conventional electrical connector.

Referring also to FIG. 3, a perspective view of another conventional electrical connector 28 is shown. The connector 28 is a BURNDY® two hole HYLUG™ electrical conductor. The connector 10 generally comprises a tube section 12 forming a cable receiving area with an inspection window 14, and a lug section 30 with two holes 18. The lug section 30 is mounted to another member by receiving two mounting posts; one in each one of the holes 18.

The two hole connector 28 is used rather than the one hole connector 10 because a larger surface area of contact between the connector and the other member (such as along the bottom surface of the lug section) is needed for electrical reasons. However, the one hole connector 10 can be used in some circumstances rather than the two hole connector 28 because the one hole connector 10 can be less expensive than the two hole connector 28.

Figure 2:
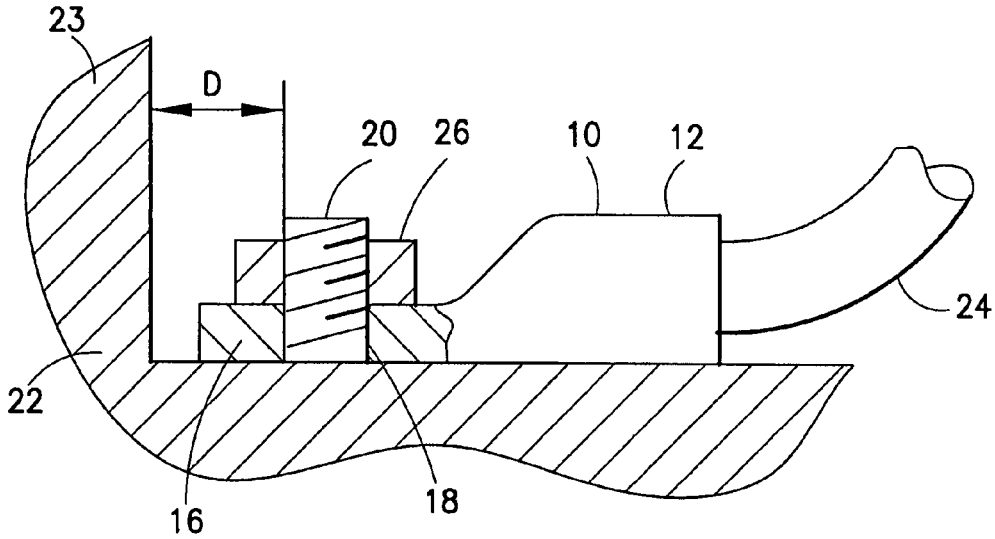
FIG. 2 PRIOR ART
FIG. 2 is an illustration showing the electrical connector of FIG. 1 being used to connect two conductors to each other.

As can be seen with reference to FIG. 2, in some circumstances, because of the environment, only enough space is available for a one hole connector to be used. For example, the distance D between the post 20 and portion 23 of the member 22 might not allow the lug section 30 to be installed. The size of the lug section 30 of the two hole connector 28 would be too large for use in the available area for the connector. However, a user might only have the two hole connector 28 available. In this instance, as noted above, installers are cutting the two-hole lug section 30 with a saw to make a one-hole lug section. The problem is that only the whole connector having the two-hole lug section is UL approved. Modifications to the two-hole lug could void the UL approval, especially if an installer gets a bit aggressive while removing the extra lug hole portion of the two-hole lug.

Figure 4:
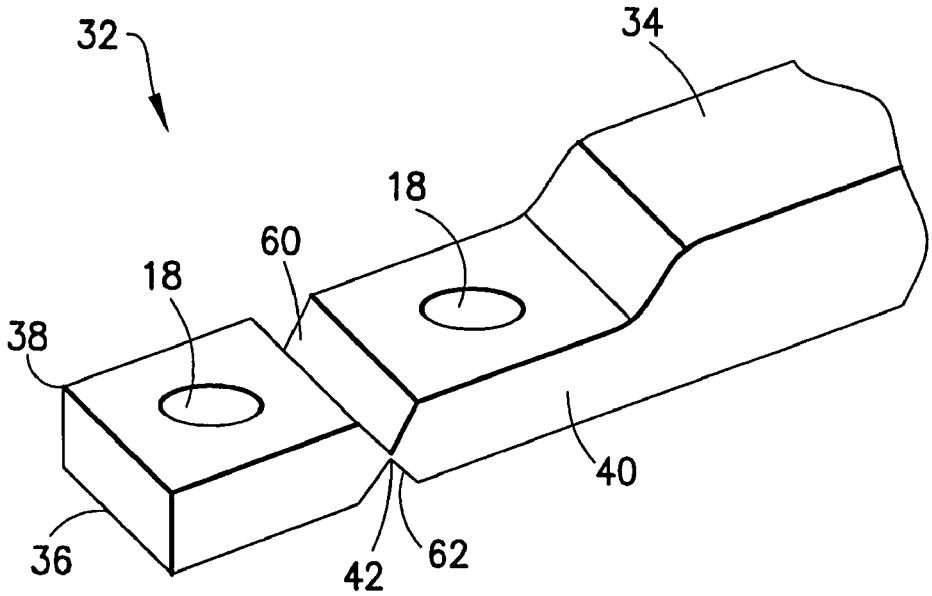
FIG. 4 is a perspective view of an electrical connector comprising features of the present invention.

Referring now to FIG. 4, a perspective view of a portion of an electrical connector 32 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The connector 32 generally comprises a one-piece metal member having a first connection section 34 and a second connection section 36. The first connection section 34 could comprise any suitable connection section for connection to another member, such as a tube section to be crimped onto a wire or cable for example. The second connection section 36 is a lug section or pad or tongue having two mounting holes 18 similar to the connector 28 shown in FIG. 3. However, the lug section 36 has a front portion 38 and a rear portion 40 connected by a weakened section 42. The weakened section 42 comprises laterally extending recesses 60, 62 along the top and bottom sides of the lug section 36 between the front portion 38 and the rear portion 40. The weakened section 42 provides a section of the lug which has a different cross section than the rest of the lug. Preferably, this reduced cross section is weaker than the cross section of the lug at the holes 18. In alternate embodiments, only the top side recess 60 or the bottom side recess 62 could be provided. In another alternate embodiment one or both recesses could comprise a series of non-connected indentations or holes through the height of the lug section. In alternate embodiments, any suitable type or shape of weakened section could be provided.

Figure 5:
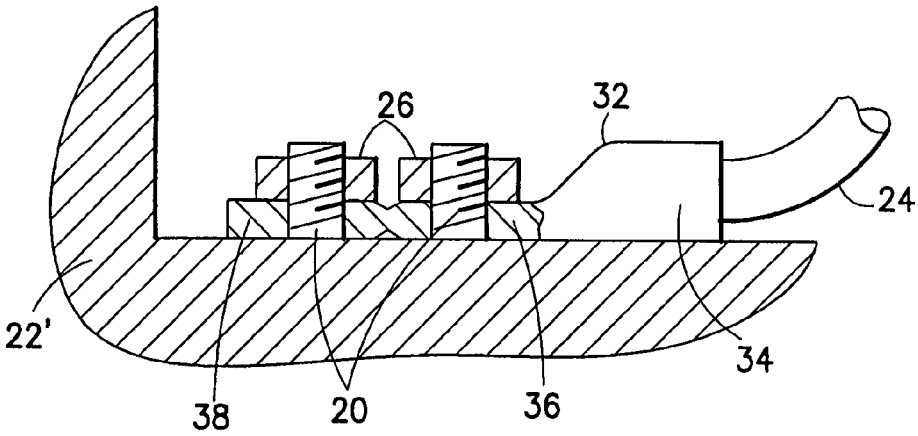
FIG. 5 is a side view of the electrical connector shown in FIG. 4 being used to connect two conductors together.
Figure 6:
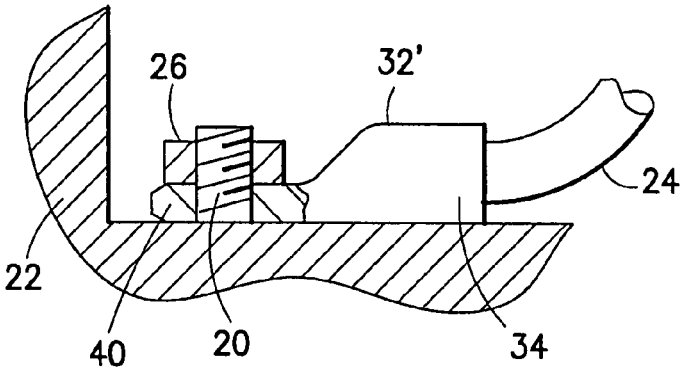
FIG. 6 is a side view of the electrical connector shown in FIG. 4 with a front lug portion removed and being used to connect two conductors together.

The weakened section 42 allows a user to separate the front portion 38 from the rear portion 40 in a controlled manner. With multiple connectors 32, the separation can be performed in a repeatable manner. As shown in FIG. 5, the connector 32 can be used to connect the cable 24 to the member 22' without separating the front portion 38. The lug section 36 can be mounted to the two posts 20 with the fasteners 26. However, as shown in FIG. 6, the same connector can be modified by a user/installer by removing the front portion 38 to form the connector 32' for connection to the member 22.

The separation of the front portion 38 from the rear portion 40 could comprise, for example, the use of pliers to bend the lug section at the weakened section and, through metal fatigue, break the weakened section. As another example, a saw could be used to cut the weakened section with the groove(s) of the weakened section forming a guide for the saw. In an alternate embodiment, more than two lug portions could be provided and more than one weakened section could be provided.

With the invention, an existing two-hole lug can be fitted or re-designed with one or more grooves 60, 62 so that the two-hole lug can be modified into a one-hole lug as described above. In a preferred method, the connector will be UL approved in both its one-hole version, such as 32' for example, and its multi-hole version, such as 32 for example. Thus, with the invention, a two-hole lug can be modified, in a controlled, reproducible manner into a one-hole lug without voiding the UL approval.

Figure 9:
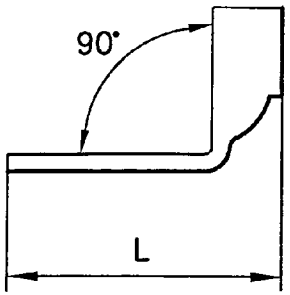
FIG. 9 is a side view of another alternate embodiment of the electrical connector shown in FIG. 7.
Figure 8:
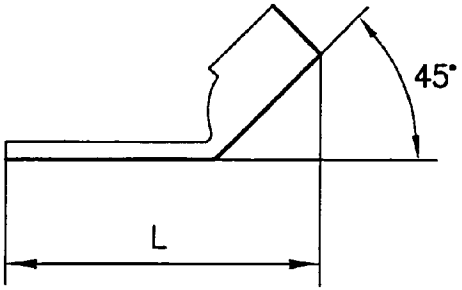
FIG. 8 is a side view of an alternate embodiment of the electrical connector shown in FIG. 7.
Figure 7:
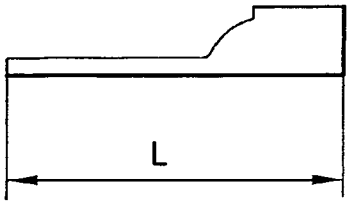
FIG. 7 is a side view of the electrical connector shown in FIG. 4.

Two-hole lugs are known. Cutting two-hole lugs with a saw to make one-hole lugs is also known. Using break-away segments to decrease (or increase) length of an object is also known. However, with the invention, the unexpected result of a guaranteed UL approval for both the two-hole lug and the modified one-hole lug can be provided. FIGS. 7-9 illustrate that features of the invention can be used with the first and second connection sections angled at different angles relative to each other.

Figure 10:
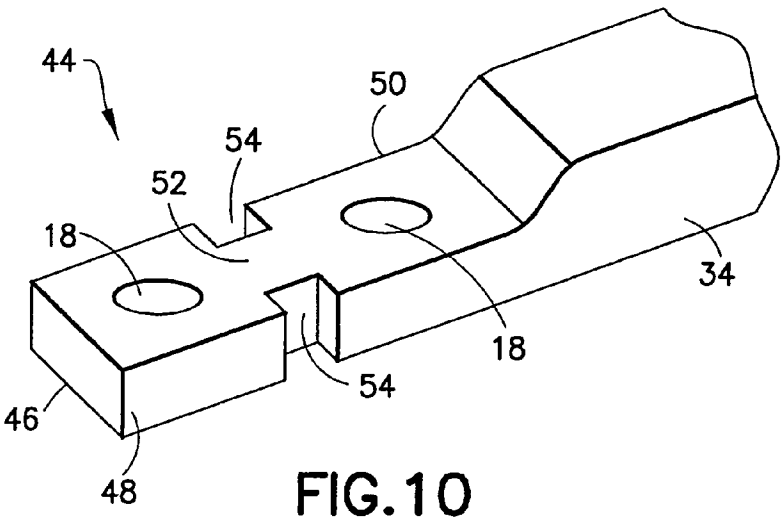
FIG. 10 is a perspective view of another alternate embodiment of the electrical connector shown in FIG. 4.

FIG. 10 is a partial perspective view of another embodiment of the invention. In this embodiment, The connector 44 generally comprises a one-piece metal member having a first connection section 34 and a second connection section 46. The first connection section 34 could comprise any suitable connection section for connection to another member, such as a tube section to be crimped onto a wire or cable for example. The second connection section 46 is a lug section having two mounting holes 18 similar to the connector 28 shown in FIG. 3. The lug section 46 has a front portion 48 and a rear portion 50 connected by a weakened section 52. The weakened section 52 comprises inwardly extending recesses 54 at lateral sides of the lug section 46 between the front portion 38 and the rear portion 40. The weakened section 52 allows a user to separate the front portion 48 from the rear portion 50 in a controlled manner. With multiple connectors 44, the separation can be performed in a repeatable manner.

There are many instances during connector installations in which there is a need to quickly modify a pad or tongue of an electrical connector in order to suit limitations in the installation or in the overall application. Specifically, it is necessary to modify the length or size of a pad/tongue so that a long size pad can be modified to create a short size pad.

Current solutions to this dilemma include the use of a vice, hacksaw or other means to cut, shear and remove the material. These are time consuming and "ugly" solutions that could result in inconsistent results at best, or unacceptable results as worst. A solution is needed that will allow for easy modification of existing designs that will provide consistently modified product, safely and still with electrical continuity.

The solution is integrated into the design of the invention. A preferred embodiment would include the inclusion of a crease or seam in the pad, which still provides the necessary electrical cross-section if the pad was to be used as-is, but will also allow the user to easily remove the excess pad that may not be needed in the application. The use of a pair of channel-lock pliers or other non-cutting means will allow for an easy, safe, and electrically compliant installation and solve the dilemma faced by installers in the field.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An electrical connector comprising:

a first connection section configured to connect the electrical connector to a first electrical conductor; and a second connection section connected to the first connection section, wherein the second connection section is configured to connect the electrical connector to a second electrical conductor;

wherein the electrical connector is configured to be modified in a predetermined fashion from a first predetermined connection configuration to a second predetermined connection configuration, wherein the electrical connector is Underwriters Laboratory (UL) certified in both the first and second predetermined connection configurations.

2. A method comprising:

providing an electrical connector having a first connection section configured to connect the electrical connector to a first electrical conductor and a second connection section connected to the first connection section, wherein the second connection section is configured to connect the electrical connector to a second electrical conductor;

providing a reconfiguration section on the electrical connector to allow the electrical connector to be modified in a predetermined fashion from a first predetermined connection configuration to a second different predetermined connection configuration, wherein the electrical connector is Underwriters Laboratories (UL) certified in both the first and second predetermined connection configurations.

* * * * *